US005284573A

United States Patent [19]

LaPierre et al.

[11] Patent Number: 5,284,573

[45] Date of Patent: * Feb. 8, 1994

[54] SIMULTANEOUS CATALYTIC HYDROCRACKING AND HYDRODEWAXING OF HYDROCARBON OILS WITH ZEOLITE BETA

[75] Inventors: Rene B. LaPierre, Medford; Randall D. Partridge, Princeton, both of N.J.

[73] Assignee: Mobil Oil Corporation, Fairfax, Va.

[ * ] Notice: The portion of the term of this patent subsequent to Dec. 6, 2000 has been disclaimed.

[21] Appl. No.: 907,971

[22] Filed: Jul. 2, 1991

Related U.S. Application Data

[60] Division of Ser. No. 675,124, Mar. 25, 1991, Pat. No. 5,128,024, which is a continuation of Ser. No. 544,792, Jun. 29, 1990, abandoned, which is a continuation of Ser. No. 383,700, Jul. 24, 1989, abandoned, which is a continuation of Ser. No. 379,421, May 18, 1982, abandoned.

[51] Int. Cl.[5] ..... C10G 45/62; C10G 45/64; C10G 47/18; C10G 47/20

[52] U.S. Cl. ..... 208/89; 208/111; 208/59

[58] Field of Search ..... 208/59, 89, 111

[56] References Cited

U.S. PATENT DOCUMENTS

| | | | |
|---|---|---|---|
| Re. 283,341 | 2/1975 | Wadlinger et al. | 208/120 |
| 4,283,271 | 8/1981 | Garwood et al. | 208/59 |
| 4,283,272 | 8/1981 | Garwood et al. | 208/59 |
| 4,347,121 | 8/1982 | Mayer et al. | 208/58 |
| 4,414,097 | 11/1983 | Chester et al. | 208/59 |
| 4,501,926 | 2/1985 | LaPierre et al. | 585/739 |
| 4,561,967 | 12/1985 | Miller | 208/120 |
| 4,592,828 | 6/1986 | Chu et al. | 208/89 |
| 5,128,024 | 7/1992 | La Pierre et al. | 208/89 |

OTHER PUBLICATIONS

Frillette et al., Catalysis by Crystalline Aluminosilicates. Constraint Index. Journal of Catalysis 67, 218-222 (1981).

*Primary Examiner*—Helane Myers
*Attorney, Agent, or Firm*—A. J. McKillop; M. D. Keen

[57] ABSTRACT

Heavy oils are simultaneously subjected to hydrocracking and dewaxing using a catalyst based on zeolite beta together with a hydrogenation component. The process is able to effect a bulk conversion of the oil while, at the same time, yielding a low pour point product.

8 Claims, No Drawings

SIMULTANEOUS CATALYTIC HYDROCRACKING AND HYDRODEWAXING OF HYDROCARBON OILS WITH ZEOLITE BETA

REFERENCE TO RELATED APPLICATION

This application is a division of co-pending application Ser. No. 07/675,124, filed Mar. 25, 1991, now U.S. Pat. No. 5,128,024. Ser. No. 07/675,124 was a continuation of Ser. No. 07/544,792, filed Jun. 29, 1990 now abandoned, which was a continuation of Ser. No. 07/383,700, filed Jul. 24, 1989, now abandoned, which was a continuation of Ser. No. 06/379,421, filed May 18, 1982, now abandoned.

U.S. patent application Ser. No. 06/379,420, filed May 18, 1982 and now abandoned, by R. B. LaPierre and R. D. Partridge and entitled Hydrocracking Process with Improved Distillate Selectivity describes a hydrocracking process using highly siliceous, large pore zeolite catalysts.

FIELD OF THE INVENTION

This invention is concerned with a process for catalytically hydrocracking and hydrodewaxing hydrocarbon charge stocks to produce low pour point distillates and heavy fuel oils of reduced viscosity.

THE PRIOR ART

Catalytic dewaxing of hydrocarbon oils to reduce the temperature at which separation of waxy hydrocarbons occurs is a known process. A process of that nature is described in *The Oil and Gas Journal* dated Jan. 6, 1975, at pages 69–73. See also U.S. Pat. No. 3,668,113 and U.S. Pat. No. 3,894,938 which describe dewaxing followed by hydrofinishing.

U.S. Pat. No. Re. 28,398 describes a process for catalytic dewaxing with a catalyst comprising a zeolite of the ZSM-5 type. A hydrogenation/dehydrogenation component may be present.

A process for hydrodewaxing a gas oil with a ZSM-5 type catalyst is described in U.S. Pat. No. 3,956,102.

A mordenite catalyst containing a Group VI or a Group VIII metal is used to dewax a low V.I. distillate from a waxy crude, as described in U.S. Pat. No. 4,110,056.

U.S. Pat. No. 3,755,138 describes a process for mild solvent dewaxing to remove high quality wax from a lube stock, which is then catalytically dewaxed to specification pour point.

U.S. Pat. No. 3,923,641 describes a process for hydrocracking napthas using zeolite beta as a catalyst.

Hydrocracking is a well known process and various zeolite catalysts have been employed in hydrocracking processes but although they may be effective in providing distillate yields having one or more properties consistent with the intended use of the distillate, these catalysts have, in general, suffered the disadvantage of not providing product yields having good low temperature fluidity characteristics, especially reduced pour point and viscosity. The catalysts used for hydrocracking comprise an acid component and a hydrogenation component. The hydrogenation component may be a noble metal such as platinum or palladium or a non-noble metal such as nickel, molybdenum or tungsten or a combination of these metals. The acidic cracking component may be an amorphous material such as an acidic clay or amorphous silica-alumina or, alternatively, a zeolite. Large pore zeolites such as zeolites X or Y have been conventionally used for this purpose because the principal components of the feedstocks (gas oils, coker bottoms, reduced crudes, recycle oils, FCC bottoms) are higher molecular weight hydrocarbons which will not enter the internal pore structure of the smaller pore zeolites and therefore will not undergo conversion. So, if waxy feedstocks such as Amal Gas Oil are hydrocracked with a large pore catalyst such as zeolite Y in combination with a hydrogenation component, the viscosity of the oil is reduced by cracking most of the 650° F.+ (343° C.+) material into material that boils at 650° F. to 330° F. (343° C. to 165° C.). The remainder of the 650° F.+ (343° C.+) material that is not converted contains the majority of the paraffinic components in the feedstock because the aromatics are converted preferentially to the paraffins. The unconverted 650° F.+ (343° C.+) material therefore retains a high pour point so that the final product will also have a relatively high pour point of about 50° F. (10° C.). Thus, although the viscosity is reduced, the pour point would still be unacceptable. Even if the conditions are adjusted to give complete or nearly complete conversion, the higher molecular weight hydrocarbons, which are present in the feedstock, principally polycyclic aromatics, will be subjected to cracking so as to lead to further reductions in the viscosity of the product. The cracking products, however, will include a substantial proportion of straight chain components (n-paraffins) which, if they are of sufficiently high molecular weight themselves, as they often are, will constitute a waxy component in the product. The final product may therefore be proportionately more waxy than the feedstock and, consequently, may have a pour point which is equally unsatisfactory or even more so. A further disadvantage of operating under high conversion conditions is that the consumption of hydrogen is increased. Attempts to reduce the molecular weight of these straight chain paraffinic products will only serve to produce very light fractions e.g. propane, so decreasing the desired liquid yield.

In the dewaxing process, on the other hand, a small pore zeolite or a shape selective zeolite such as ZSM-5 is used as the acidic component of the catalyst and the normal and slightly branched chain paraffins which are present in the feedstock will be able to enter the internal pore structure of the zeolite so that they will undergo conversion. The major proportion—typically about 70 percent of the feedstock—boiling above 650° F. (343° C.) will remain unconverted because the bulky aromatic components, especially the polycyclic aromatics, are unable to enter the zeolite. The paraffinic waxy components will therefore be removed so as to lower the pour point of the product but the other components will remain so that the final product will have an unacceptable high viscosity even though the pour point may be satisfactory.

SUMMARY OF THE INVENTION

It has now been found that heavy hydrocarbon oils may be simultaneously hydrocracked and hydrodewaxed to produce a liquid product of satisfactory pour point and viscosity. This desirable result is obtained by the use of a catalyst which contains zeolite beta as an acidic component to induce the cracking reactions. The catalyst preferably includes a hydrogenation component to induce hydrogenation reactions. The hydrogenation component may be a noble metal or a non-noble metal and is suitably of a conventional type, e.g. nickel, tungsten, cobalt, molybdenum or combinations of these metals.

The hydrocarbon feedstock is heated with the catalyst under conversion conditions which are appropriate for hydrocracking. During the conversion, the aromatic and naphthenes which are present in the feedstock undergo hydrocracking reactions such as dealkylation, ring opening and cracking, followed by hydrogenation. The long chain paraffins which are present in the feedstock, together with the paraffins produced by the hydrocracking of the aromatics are, in addition, converted to products which are less waxy than the straight chain n-paraffins, thereby effecting a simultaneous dewaxing. The use of zeolite beta is believed to be unique in this respect, producing not only a reduction in the viscosity of the product by hydrocracking but also a simultaneous reduction in pour point by catalytic hydrodewaxing.

The process enables heavy feedstocks such as gas oils boiling above 650° F. (343° C.) to be converted to distillate range products boiling below 650° F. (343° C.) but in contrast to prior processes using large pore catalysts such as zeolite Y, the consumption of hydrogen will be reduced even though the product will conform to the desired specifications for pour point and viscosity. In contrast to dewaxing processes using shape selective catalysts such as zeolite ZSM-5, the bulk conversion including cracking of aromatic components takes place, ensuring acceptably low viscosity in the distillate range product. Thus, the present process is capable of effecting a bulk conversion together with a simultaneous dewaxing. Moreover, this is achieved with a reduced hydrogen consumption as compared to the other types of process. It is also possible to operate at partial conversion, thus effecting economies in hydrogen consumption while still meeting pour point and viscosity requirements. The process also achieves enhanced selectivity for the production of distillate range materials; the yield of gas and products boiling below the distillate range is reduced.

DESCRIPTION OF PREFERRED EMBODIMENTS

Catalysts

As mentioned above, the present hydrocarbon conversion process combines elements of hydrocracking and dewaxing. The catalyst used in the process has an acidic component and a hydrogenation component which may be conventional in type. The acidic component comprises zeolite beta, which is described in U.S. Pat. Nos. 3,303,069 and Re.28,341 and reference is made to these patents for details of this zeolite and its preparation.

Zeolite beta is a crystalline aluminosilicate zeolite having a pore size greater than 5 Angstroms. The composition of the zeolite as described in U.S. Pat. Nos. 3,303,069 and Re.28,341, in its as synthesized form may be expressed as follows:

$$[XNa(1.0\pm0.1-X)TEA]AlO_2.YSiO_2.WH_2O$$

where X is less than 1, preferably less than 0.7; TEA represents the tetraethylammonium ion; Y is greater than 5 but less than 100 and W is up to about 60 (it has been found that the degree of hydration may be higher than originally determined, where W was defined as being up to 4), depending on the degree of hydration and the metal cation present. The TEA component is calculated by differences from the analyzed value of sodium and the theoretical cation to structural aluminum ratio of unity.

In the fully base-exchanged form, beta has the composition:

$$\left[\frac{x}{n}M(1\pm).1-X)H\right].AlO_2.YSiO_2.WH_2O$$

where X, Y and W have the values listed above and n is the valence of the metal M.

In the partly base-exchanged form which is obtained from the initial sodium form of the zeolite by ion exchange without calcining, zeolite beta has the formula:

$$\left[\frac{x}{n}M(1\pm0.1-X)TEA\right]AlO_2.YSiO_2.WH_2O$$

When it is used in the present catalysts, the zeolite is at least partly in the hydrogen form in order to provide the desired acidic functionality for the cracking reactions which are to take place. It is normally preferred to use the zeolite in a form which has sufficient acidic functionality to give it an alpha value of 1 or more. The alpha value, a measure of zeolite acidic functionality, is described, together with details of its measurement in U.S. Pat. No. 4,016,218 and in J. Catalysis, Vol. VI, pages 278–287 (1966) and reference is made to these for such details. The acidic functionality may be controlled by base exchange of the zeolite, especially with alkali metal cations such as sodium, by steaming or by control of the silica:alumina ratio of the zeolite.

When synthesized in the alkali metal form, zeolite beta may be converted to the hydrogen form by formation of the intermediate ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable metal cations including, by way of example, nickel, copper, zinc, palladium, calcium or rare earth metals.

Zeolite beta, in addition to possessing a composition as defined above, may also be characterized by its X-ray diffraction data which are set out in U.S. Pat. Nos. 3,308,069 and Re.28,341. The significant d values (Angstroms, radiation: K alpha doublet of copper, Geiger counter spectrometer) are as shown in Table 1 below:

TABLE 1 d Values of Reflections in Zeolite Beta

| |
|---|
| 11.40+0.2 |
| 7.40+0.2 |
| 6.70+0.2 |
| 4.25+0.1 |
| 3.97+0.1 |
| 3.00+0.1 |
| 2.20+0.1 |

The preferred forms of zeolite beta for use in the present process are the high silica forms, having a silica:alumina ratio of at least 30:1. It has been found, in fact, that zeolite beta may be prepared with silica:alumina ratios above the 100:1 maximum specified in U.S. Pat. Nos. 3,308,069 and Re.28,341 and these forms of the zeolite provide the best performance in the process. Ratios of at least 50:1 and preferably at least 100:1 or even higher e.g. 250:1, 500:1 may be used.

The silica:alumina ratios referred to in this specification are the structural or framework ratios, that is, the ratio of the $SiO_4$ to the $AlO_4$ tetrahedra which together constitute the structure of which the zeolite is composed. It should be understood that this ratio may vary from the silica:alumina ratio determined by various physical and chemical methods. For example, a gross chemical analysis may include aluminum which is present in the form of cations associated with the acidic sites on the zeolite, thereby giving a low silica:alumina ratio. Similarly, if the ration is determined by the thermogravimetric analysis (TGA) of ammonia desorption, low ammonia titration may be obtained if cationic aluminum prevents exchange of the ammonium ions onto the acidic sites. These disparities are particularly troublesome when certain treatments such as the dealuminization method described below which result in the presence of ionic aluminum free of the zeolite structure are employed. Due care should therefore be taken to ensure that the framework silica:alumina ratio is correctly determined.

The silica:alumina ratio of the zeolite may be determined by the nature of the starting materials used in its preparation and their quantities relative one to another. Some variation in the ratio may therefore be obtained by changing the relative concentration of the silica precursor relative to the alumina precursor but definite limits in the maximum obtainable silica:alumina ratio of the zeolite may be observed. For zeolite beta this limit is usually about 100:1 (although higher ratios may be obtained) and for ratios above this value, other methods are usually necessary for preparing the desired high silica zeolite. One such method comprises dealumination by extraction with acid and this method is disclosed in detail in U.S. patent application Ser. No. 379,399, filed May 18, 1982, by R. B. LaPierre and S. S. Wong, entitled "High Silica Zeolite Beta" and now abandoned, and reference is made to this application for additional details of the method.

Briefly, the method comprises contacting the zeolite with an acid, preferably a mineral acid such as hydrochloric acid. The dealuminization proceeds readily at ambient and mildly elevated temperatures and occurs with minimal losses in crystallinity, to form high silica forms of zeolite beta with silica:alumina ratios of at least 100:1, with ratios of 200:1 or even higher being readily attainable.

The zeolite is conveniently used in the hydrogen form for the dealuminization process although other cationic forms may also be employed, for example, the sodium form. If these other forms are used, sufficient acid should be employed to allow for the replacement by protons of the original cations in the zeolite. The amount of zeolite in the zeolite/acid mixture should generally be from 5 to 60 percent by weight.

The acid may be a mineral acid, i.e., an inorganic acid or an organic acid. Typical inorganic acids which can be employed include mineral acids such as hydrochloric, sulfuric, nitric and phosphoric acids, peroxydisulfonic acid, dithionic acid, sulfamic acid, peroxymonosulfuric acid, amidodisulfonic acid, nitrosulfonic acid, chlorosulfuric acid, pyrosulfuric acid, and nitrous acid. Representative organic acids which may be used include formic acid, trichloroacetic acid, and trifluoroacetic acid.

The concentration of added acid should be such as not to lower the pH of the reaction mixture to an undesirably low level which could affect the crystallinity of the zeolite undergoing treatment. The acidity which the zeolite can tolerate will depend, at least in part, upon the silica/alumina ratio of the starting material. Generally, it has been found that zeolite beta can withstand concentrated acid without undue loss in crystallinity but as a general guide, the acid will be from 0.1N to 4.0N, usually 1 to 2N. These values hold good regardless of the silica:alumina ratio of the zeolite beta starting material. Stronger acids tend to effect a relatively greater degree of aluminum removal than weaker acids.

The dealuminization reaction proceeds readily at ambient temperatures but mildly elevated temperatures may be employed e.g. up to 100° C. The duration of the extraction will affect the silica:alumina ratio of the product since extraction, being diffusion controlled, is time dependent. However, because the zeolite becomes progressively more resistant to loss of crystallinity as the silica:alumina ratio increases i.e. it becomes more stable as the aluminum is removed, higher temperatures and more concentrated acids may be used towards the end of the treatment than at the beginning without the attendent risk of losing crystallinity.

After the extraction treatment, the product is water washed free of impurities, preferably with distilled water, until the effluent wash water has a pH within the approximate range of 5 to 8.

The crystalline dealuminized products obtained by the method of this invention have substantially the same crystallographic structure as that of the starting aluminosilicate zeolite but with increased silica:alumina ratios. The formula of the dealuminized zeolite beta will therefore be $$\left[\frac{X}{n}M(1 \pm 0.1 - X)H\right]AlO_2 . YSiO_2 . WH_2O$$

where X is less than 1, preferably less than 0.75, Y is at least 100, preferably at least 150 and W is up to 60. M is a metal, preferably a transition metal or a metal of Groups IA, 2A or 3A, or a mixture of metals. The silica:alumina ratio, Y, will generally be in the range of 100:1 to 500:1, more usually 150:1 to 300:1, e.g. 200:1 or more. The X-ray diffraction pattern of the dealuminized zeolite will be substantially the same as that of the original zeolite, as set out in Table 1 above.

If desired, the zeolite may be steamed prior to acid extraction so as to increase the silica:alumina ratio and render the zeolite more stable to the acid. The steaming may also serve to increase the ease with which the acid is removed and to promote the retention of crystallinity during the extraction procedure.

The zeolite beta is preferably used in combination with a hydrogenating component which is usually derived from a metal of Groups VA, VIA or VIIIA of the Periodic Table (the Periodic Table used in this specification is the table approved by IUPAC and the U.S. National Bureau of Standards and is known, for example, in the table of the Fisher Scientific Company, Catalog No. 5-702-10). Preferred non-noble metals are such as tungsten, vanadium, molybdenum, nickel, cobalt, chromium, and manganese, and the preferrred noble metals are platinum, palladium, iridium and rhodium. Combinations of non-noble metals such as cobalt-molybdenum, cobalt nickel, nickel-tungsten or cobalt-nickel-tungsten are exceptionally useful with many feedstocks and in a preferred embodiment, the hydrogenation component is about 0.7 to about 7 wt. % nickel and about 2.1 to about 21 wt. % tungsten, expressed as metal. The hydrogenation component can be exchanged onto the zeolite, impregnated into it or physically admixed with it. If the metal is to be impregnated into or exchanged onto the zeolite, it may be done, for example, by treating the zeolite with a platinum metal-containing ion. Suitable platinum compounds include chloroplatinic acid, platinous chloride and various compounds containing tthe platinum ammine complex.

The catalyst may be treated by conventional pre-sulfiding treatments e.g. by heating in the presence of hydrogen sulfide, to convert oxide forms of the metals such as CoO or NiO to their corresponding sulfides.

The metal compounds may be either compounds in which the metal is present in the cation of the compound and compounds in which it is present in the anion of the compound. Both types of compounds can be used. Platinum compounds in which the metal is in the form of a cation or cationic complex, e.g., $Pt(NH_3)_4Cl_2$ are particularly useful, as are anionic complexes such as the vanadate and metatungstate ions. Cationic forms of other metals are also very useful since they may be exchanged onto the zeolite or impregnated into it.

Prior to use the zeolite should be dehydrated at least partially. This can be done by heating to a temperature in the range of 200° C. to 600° C. in air or an inert atmosphere such as nitrogen for 1 to 48 hours. Dehydration can also be performed at lower temperatures merely by using a vacuum, but a longer time is required to obtain a sufficient amount of dehydration.

It may be desirable to incorporate the catalyst in another material resistant to the temperature and other conditions employed in the process. Such matrix materials include synthetic and naturally occurring substances such as inorganic materials e.g. clay, silica and metal oxides. The latter may be either naturally occurring or in the form of gelatinous precipitates or gels including mixtures of silica and metal oxides. Naturally occurring clays can be composited with the zeolite including those of the montmorillonite and kaolin families. The clays can be used in the raw state as originally mined or initially subjected to calcination, acid treatment or chemical modification.

The zeolite may be composited with a porous matrix material, such as alumina, silica-alumina, silica-magnesia, silica-zirconia, silica-thoria, silica-berylia, silica-titania, as well as terniary compositions, such as silica-alumina-thoria, silica-alumina-zirconia, magnesia and silica-magnesia-zirconia. The matrix may be in the form of a cogel. The relative proportions of zeolite component and inorganic oxide gel matrix on an anhydrous basis may vary widely with the zeolite content ranging from 10 to 99, more usually 25 to 80, percent by weight of the dry composite. The matrix itself may possess catalytic properties, generally of an acidic nature.

Feedstock

The feedstock for the present conversion process comprises a heavy hydrocarbon oil such as a gas oil, coker tower bottoms fraction reduced crude, vacuum tower bottoms, deasphalted vacuum resids, FCC tower bottoms, cycle oils. Oils derived from coal, shale, or tar sands may also be treated in this way. Oils of this kind generally boil above 650° F. (343° C.) although the process is also useful with oils which have initial boiling points as low as 500° F. (260° C.). These heavy oils comprise high molecular weight long chain paraffins and high molecular weight aromatics with a large proportion of fused ring aromatics. During the processing, the fused ring aromatics and naphthenes are cracked by the acidic catalyst and the paraffinic cracking products, together with paraffinic components of the initial feedstock undergo conversion to iso-paraffins with some cracking to lower molecular weight materials. Hydrogenation of unsaturated side chains on the monocyclic cracking residues of the original polycyclics is catalyzed by the hydrogenation component to form substituted monocyclic aromatics which are highly desirable end products. The heavy hydrocarbon oil feedstock will normally contain a substantial amount boiling above 230° C. (450° F.) and will normally have an initial boiling point of about 290° C. (about 550° F.), more usually about 340° C. (about 650° F.). Typical boiling ranges will be about 340° to 565° C. (650° to 1050° F.) or about 340° F. to 510° C. (650° to 950° F.) but oils with a narrower boiling range may, of course, be processed, for example, those with a boiling range of about 340° to 455° C. (650° to 850° F.). Heavy gas oils are often of this kind as are cycle oils and other non-residual materials. It is possible to co-process materials boiling below 260° C. (500° F.) but the degree of conversion will be lower for such components. Feedstocks containing lighter ends of this kind will normally have an initial boiling point above 150° C. (about 300° F.).

The present process is of particular utility with highly paraffinic feeds because, with feeds of this kind, the greatest improvement in pour point may be obtained. However, most feeds will contain a certain content of polycyclic aromatics.

Process Conditions

The processing is carried out under conditions similar to those used for conventional hydrocracking although the use of the highly siliceous zeolite catalyst permits the total pressure requirements to be reduced. Process temperatures of 230° C. to 500° C. (450° F. to 930° F.) may conveniently be used although temperatures above 425° C. (800° F.) will normally not be employed as the thermodynamics of the hydrocracking reactions become unfavorable at temperatures above this point. Generally, temperatures of 300° C. to 425° C. (570° F. to 800° F.) will be employed. Total pressure is usually in the range of 500 to 20,000 kPa (58 to 2886 psig) and the higher pressures within this range over 7000 kPa (986 psig) will normally be preferred. The process is operated in the presence of hydrogen and hydrogen partial pressures will normally be from 600 to 6000 kPa (72 to 2305 psig). The ratio of hydrogen to the hydrocarbon feedstock (hydrogen circulation rate) will normally be from 10 to 3500 $n.l.l^{-1}$ (56 to 19,660 SCF/bbl). The space velocity of the feedstock will normally be from 0.1 to 20 LHSV, preferably 0.1 to 10 LHSV. At low conversions, the n-paraffins in the feedstock will be converted in preference to the iso-paraffins but at higher conversions under more severe conditions the iso-paraffins will also be converted. The product is low in fractions boiling below 150° C. (about 300° F.) and in most cases the product will have a boiling range of 150° to 340° C. (about 300° to 650° F.).

The conversion may be conducted by contacting the feedstock with a fixed stationary bed of catalyst, a fixed fluidized bed or with a transport bed. A simple configuration is a trickle-bed operation in which the feed is allowed to trickle through a stationary fixed bed. With such a configuration, it is desirable to initiate the reaction with fresh catalyst at a moderate temperature which is of course raised as the catalyst ages, in order to maintain catalytic activity. The catalyst may be regenerated by contact at elevated temperature with hydrogen gas, for example, or by burning in air or other oxygen-containing gas.

A preliminary hydrotreating step to remove nitrogen and sulfur and to saturate aromatics to naphthenes without substantial boiling range conversion will usually improve catalyst performance and permit lower temperatures, higher space velocities, lower pressures or combinations of these conditions to be employed.

The improved process of this invention is illustrated by the following Examples. All parts and proportions in these Examples are by weight unless stated to the contrary.

EXAMPLE 1

This Example illustrates the preparation of a catalyst.

A mixture of zeolite beta ($SiO_2/Al_2O_3=30$) having a crystallite size of less than 0.05 microns and an equal amount gamma alumina on an anhydrous basis was extruded to form 1.5 mm. pellets. The pellets were calcined at 540° C. in nitrogen, magnesium exchanged, and then calcined in air.

One hundred grams of the air-calcined extrudate was impregnated with 13.4 grams of ammonium metatungstate (72.3%W) in 60 cc of water, followed by drying at 115° C. and calcination in air at 540° C. The extrudate was then impregnated with 15.1 grams of nickel hexahydrate in 60 cc of water, and the wet pellets dried and calcined at 540° C.

The final catalyst had a nickel content of about 4 weight percent as NiO and a calculated tungsten content of about 10.0 weight percent as $WO_3$. The sodium content was less than 0.5 weight percent as sodium oxide.

EXAMPLE 2

This example describes the preparation of high silica zeolite beta.

A sample of zeolite beta in its as synthesized form and having a silica:alumina ratio of 30:1 was calcined in flowing nitrogen at 500° C. for 4 hours, followed by air at the same temperature for 5 hours. The calcined zeolite was then refluxed with 2N hydrochloric acid at 95° C. for one hour to produce a dealuminized, high silica form of zeolite beta having a silica:alumina ratio of 280:1, an alpha value of 20 and a crystallinity of 80 percent relative to the original, assumed to be 100 percent crystalline.

The zeolite was exchanged to the ammonium form with 1N ammonium chloride solution at 90° C. reflux for an hour followed by the exchange with 1N magnesium chloride solution at 90° C. reflux for an hour. Platinum was introduced into the zeolite by ion-exchange of the tetrammine complex at room temperature. The metal exchanged zeolite was thoroughly washed and oven dried by air calcination at 350° C. for 2 hours. The finished catalyst contained 0.6 percent platinum and was pelletted, crushed and sized to 30–40 mesh (Tyler) (approx. 0.35 to 0.5 mm).

EXAMPLES 3-5

The catalyst of Example 1 was evaluated for the catalytic conversion of an Arab Light (HVGO) gas oil having a boiling range of 354° to 580° C. For comparison, a magnesium exchanged zeolite Y ($SiO_2/Al_2O_3=5$) catalyst was also composed by extrusion with an equal amount of gamma alumina and impregnation to contain 4 weight percent nickel and 10 weight percent tungsten.

The feedstock composition, conditions used and product analysis are given in Table 1 below.

TABLE 1

| Hydrocracking/Dewaxing | | | |
|---|---|---|---|
| Example No. | Feed | 3 | 4 |
| Catalyst | — | Mg Beta | MgY |
| Conditions: | | | |
| Temp., °C. | — | 423 | 414 |
| Pressure, kPA | — | 7000 | 7000 |
| LHSV, $hr^{-1}$ | — | 0.54 | 0.71 |
| $H_2$, n.l.l.$^{-1}$ | — | 1674 | 1318 |
| $H_2$ Consumption, n.l.l$^{-1}$ | — | 125 | 193 |
| 343° C. + Conversion, wt. % | — | 62.2 | 56.6 |
| Properties: | | | |
| Dry Gas + $C_4$ | — | 3.5 | 4.1 |
| $C_5$ - 165° C. Naptha, wt. % | — | 16.6 | 24.7 |
| 165° C.-343° C. Distillate, wt. % | — | 40.6 | 26.3 |
| 343° C. + wt. % | 100 | 37.8 | 44.0 |
| 343° C. + Pour Point, °C. | 40 | −1 | 35 |
| 343° C. + 95% TBP, °C. | 552 | 468 | 528 |
| 343° C. + Properties: | | | |
| Gravity, °API | 22.0 | — | — |
| Hydrogen, Wt. % | 12.07 | 12.7 | 13.7 |
| Sulfur | 2.45 | 0.04 | 0.03 |
| Nitrogen | 600 | 80 | 18 |
| Pour Point °C. | 40 | −1 | 35 |
| Paraffins, vol. % | 24.0 | 31 | 40 |
| Naphthenes, vol. % | 25.3 | 28 | 35 |
| Aromatics, vol. % | 50.7 | 41 | 25 |

As shown above in Table 1, at a relatively high conversion of approximately 60 percent, the beta catalyst significantly lowered the pour point of the 343° C.+ product whereas the products obtained with zeolite Y catalysts remain waxy. Additionally, the beta catalyst converted considerably more of the high boiling components in the charge which resulted in a 343° C.+ product endpoint about 55° C. lower than obtained with the catalyst of Examples 3 and 4, The hydrogen consumption is also notably lower whether on an absolute basis or relative to conversion.

EXAMPLE 5

For comparison with Example 3, a similar Arab Light HVGO having a boiling range of 370° to 550° C. was hydrocracked over a rare earth exchanged ultrastable zeolite Y ($SiO_2:Al_2O_3=75$). The zeolite was prepared by steam calcination and acid dealuminization of zeolite Y to a framework $SiO_2:Al_2O_3$ ratio of 75:1, followed by rare earth exchange, extrusion with an equal amount of gamma alumina and impregnation to contain 2 weight percent nickel and 7 weight percent tungsten.

The feedstock composition, conditions used and product analysis are given in Table 2 below.

TABLE 2

| Hydrocracking over REY Catalyst | | |
|---|---|---|
| Example No. | Feed | 5 |
| Conditions: | | |

TABLE 2-continued

| Hydrocracking over REY Catalyst | | |
|---|---|---|
| Example No. | Feed | 5 |
| Temp., °C. | — | 416 |
| Pressure, kPA | — | 7000 |
| LHSV, $hr^{-1}$ | — | 0.67 |
| $H_2$, n.l.l.$^{-1}$ | — | 1338 |
| $H_2$ Consumption, n.l.l$^{-1}$ | — | 143 |
| 343° C. + Conversion, wt. % | — | 60.4 |
| Properties: | | |
| Dry Gas + $C_4$ | — | 3.6 |
| $C_5$ - 165° C. Naptha, wt. % | — | 14.2 |
| 165° C.-343° C. Distillate, wt. % | — | 41.4 |
| 343° C. + wt. % | 100 | 39.6 |
| 343° C. + Pour Point, °C. | 43 | 32 |
| 343° C. + 95% TBP, °C. | 540 | 504 |
| 343° C. + Properties: | | |
| Gravity, °API | 21.7 | — |
| Hydrogen, Wt. % | 12.17 | 13.26 |
| Sulfur | 2.41 | 0.01 |
| Nitrogen | 550 | 33 |
| Pour Point °C. | 43 | 32 |
| Yields: | | |
| Paraffins, vol. % | 19 | 41 |
| Naphthenes, vol. % | 27 | 26 |
| Aromatics, vol. % | 54 | 33 |

We claim:

1. A process for hydrocracking and dewaxing a heavy hydrocarbon vacuum gas oil having an initial boiling point above 650° F. comprising high molecular weight long chain, waxy paraffins and high molecular weight aromatics including fused ring aromatics, which process comprises contacting the oil with a catalyst comprising (i) zeolite beta as an acidic component and (ii) a hydrogenation component at a temperature of 230° C. to 500° C. and in the presence of hydrogen gas at a total pressure of 500 to 20,000 kPa, a space velocity of 0.1 to 10 LHSV and a hydrogen circulation rate of 10 to 3500 n.1.1.$^{-1}$ to bring about a bulk conversion including hydrocracking of aromatic components simultaneously with a conversion of the long chain waxy paraffins present in the feed and produced by the hydrocracking reactions to effect a dewaxing of the feed simultaneously with the hydrocracking so that the pour point of the fraction of the product boiling above 650° F. is reduced relative to the pour point of the feed.

2. A process according to claim 1 in which the hydrogenation component comprises nickel, tungsten, cobalt, molybdenum or mixtures of these metals.

3. A process according to claim 2 in which the hydrogenation component comprises nickel and tungsten.

4. A process according to claim 2 in which the hydrogenation component comprises platinum, palladium or combinations of them.

5. A process according to claim 1 in which the vacuum gas oil has an end point of up to about 1050° F.

6. A process according to claim 1 in which the vacuum gas oil has an end point of up to about 950° F.

7. A process according to claim 1 in which the vacuum gas oil has a pour point of about 40° C.

8. A process according to claim 1 in which the oil is subjected to hydrotreating before the hydrocracking.

* * * * *